US006164960A

United States Patent [19]

Gibson

[11] Patent Number: 6,164,960

[45] Date of Patent: Dec. 26, 2000

[54] FLUE SEAL FOR A CARBON ANODE BAKING FURNACE

[76] Inventor: Donald B. Gibson, 2331 S. Crestline, Spokane, Wash. 99203

[21] Appl. No.: 09/467,909

[22] Filed: Dec. 21, 1999

Related U.S. Application Data

[62] Division of application No. 09/094,941, Jun. 15, 1998.
[60] Provisional application No. 60/054,914, Aug. 6, 1997.

[51] Int. Cl.[7] ..... F27D 1/18
[52] U.S. Cl. ..... 432/9; 432/242; 49/477.1
[58] Field of Search ..... 432/9, 10, 192, 432/242; 29/428; 49/477.1

[56] References Cited

U.S. PATENT DOCUMENTS 4,045,966 9/1977 Rusche ..... 61/53.64
4,160,464 7/1979 Ballinger ..... 138/93
4,163,458 8/1979 Bachmann ..... 137/240

*Primary Examiner*—Denise L. Ferensic
*Assistant Examiner*—Gregory A. Wilson
*Attorney, Agent, or Firm*—Jones, Tullar & Cooper PC

[57] ABSTRACT

A device for sealing a passageway in a flue from a carbon anode baking furnace, the flue being generally rectangular in shape and comprising a flue top and bottom, a headwall on either end of the flue, two walls, an opening in the flue top, at least one baffle, and a plurality of spacers which are connected to both walls of the flue, the headwall, the two walls and the flue top define a headwall port which permits fluid passage between adjoining flues; the sealing device comprises; an inflatable bladder; a means to deliver air under pressure connected to the inflatable bladder by a seal to prevent air leakage between the means to deliver air under pressure and the inflatable bladder; the inflatable bladder is long enough to extend from the flue top to a headwall and seal off the communication between flues at the headwall port when inflated.

6 Claims, 1 Drawing Sheet

FLUE SEAL FOR A CARBON ANODE BAKING FURNACE

This application is a divisional of copending U.S. application Ser. No. 09/094,941 filed on Jun. 15, 1998.

This application is a continuation-in-part of provisional application no. 60/054,914, filed Aug. 6, 1997, which is hereby incorporated by reference in its entirety.

FIELD OF INVENTION

This invention relates to a device used in the operation a furnace for baking molded carbon shapes. More particularly, it relates to a seal that is used in a ring-type furnaces for baking carbon anode blocks used in an electrolytic process for making a metal, such as aluminum.

BACKGROUND OF THE INVENTION

In prebake aluminum smelters, carbon anodes are baked to elevated temperatures before they are delivered to the potrooms. The baking process takes place in refractory constructed ring furnaces where anodes are stacked in pits and surrounded with coke to prevent anode deformation and exposure to air during baking. The pits are bordered on each side by flues in which fuel is burned to provide heat. These anode pits are positioned in a matrix, typically either six or seven abreast, alternately sandwiched between the flues. These sections are arranged in line with adjoining sections so the flues are connected in series, in effect forming a continuous ring Baking is performed by movement of independent fire groups over the baking sections, with packing of green anodes and removal of baked anodes occurring on either side of the sections undergoing bake. Each fire group consists of several burner bridges, a forced air cooling manifold, and an exhaust gas manifold. A burner bridge is comprised of a row of burners manifolded in parallel which are inserted into the flues of a section and individually regulated to achieve the desired flue temperature. The mobile forced draft air manifold located upstream of the burner bridges provides both the cooling air to the completed bake sections and, using this heat exchange, preheated combustion air to the fired sections. A mobile exhaust gas manifold draws the combustion gases through the fire group and directs them to an external fume treatment system. Once the desired final anode temperatures are reached in the final baking section, the entire fire group, including burner frames, cooling manifold and exhaust manifold, is repositioned one section downstream by overhead crane and another cycle is started. Typically, a fire group is moved every 24 hours, and a section of anodes completes the total cycle in about 20 days.

The firing equipment operates above the furnace and interfaces with the furnace through holes in each flue top. It is through these holes that the combustion air is induced, the fuel in introduced, and the spent gasses are extracted. Any instrumentation used to measure the conditions inside the flues is also inserted into these openings. Furnaces of this type have two to four smaller flue top openings of 3 to 5 inch diameter, and a larger opening of approximately 12 inch diameter (or square). The smaller holes are commonly called "peepholes," and are used for fuel input and instrumentation. These are always located on the flue top. The larger holes are known as exhaust port openings and are used for input of the cooling and combustion air at one end of the fire group, and for exhaust of spent gas at the other end. Depending on the furnace design, these holes are arranged one of two ways:

one exhaust port opening on the headwall plus three or four peepholes on the flue top; and no openings on the headwall, two exhaust port and two peepholes, all located on top of the flue.

In order to direct only the exhaust gasses into the external fume treatment system and prevent cooler gasses from the upstream end of the adjacent fire group from flowing backwards into the exhaust, a seal is placed inside the flue or headwall. This seal is moved each time the fire group is moved. The design most often used is a flat, flexible, high temperature cloth that is placed across the internal rectangular opening in the headwall. This seal is manually positioned by an operator while on his hands and knees exposed to heat, dust and fumes. As a furnace ages, the effectiveness of this seal decreases as a flat seal cannot be effective on an uneven surface. This leads to higher energy costs due to the need for larger fans to move the increased quantity of exhaust gas. The cooling effect of added ambient air is one of the major factors in decreased efficiency for furnaces of this type.

SUMMARY OF THE INVENTION

The present invention is a device for sealing a passageway in a flue from a carbon anode baking furnace. The flue is generally rectangular in shape and comprises a flue top and bottom, a headwall on either end of the flue, two walls, an opening in the flue top. The flue has at least one baffle and a plurality of spacers which are connected to both walls of the flue. The headwall, the two walls and the flue top define a headwall port which permits fluid passage between adjoining flues. The sealing device comprises an inflatable bladder made of a semi-permeable, heat resistant material; a means to deliver air under pressure, a first seal attached to the bladder and the means to deliver air to prevent air leakage. The inflatable bladder is long enough to extend from the flue top to a headwall and seal off the communication between flues at the headwall port when inflated.

The present system incorporates an inflatable, high-temperature tolerant, bladder to seal the headwall port near the exhaust manifold to prevent incursion of cold air into the exhaust stream. The objective of the present system is to improve the operational, ergonomic, health, and safety aspects of this portion of the carbon bake furnace firing methods and equipment.

DETAILED DESCRIPTION OF THE INVENTION

Figure 1:
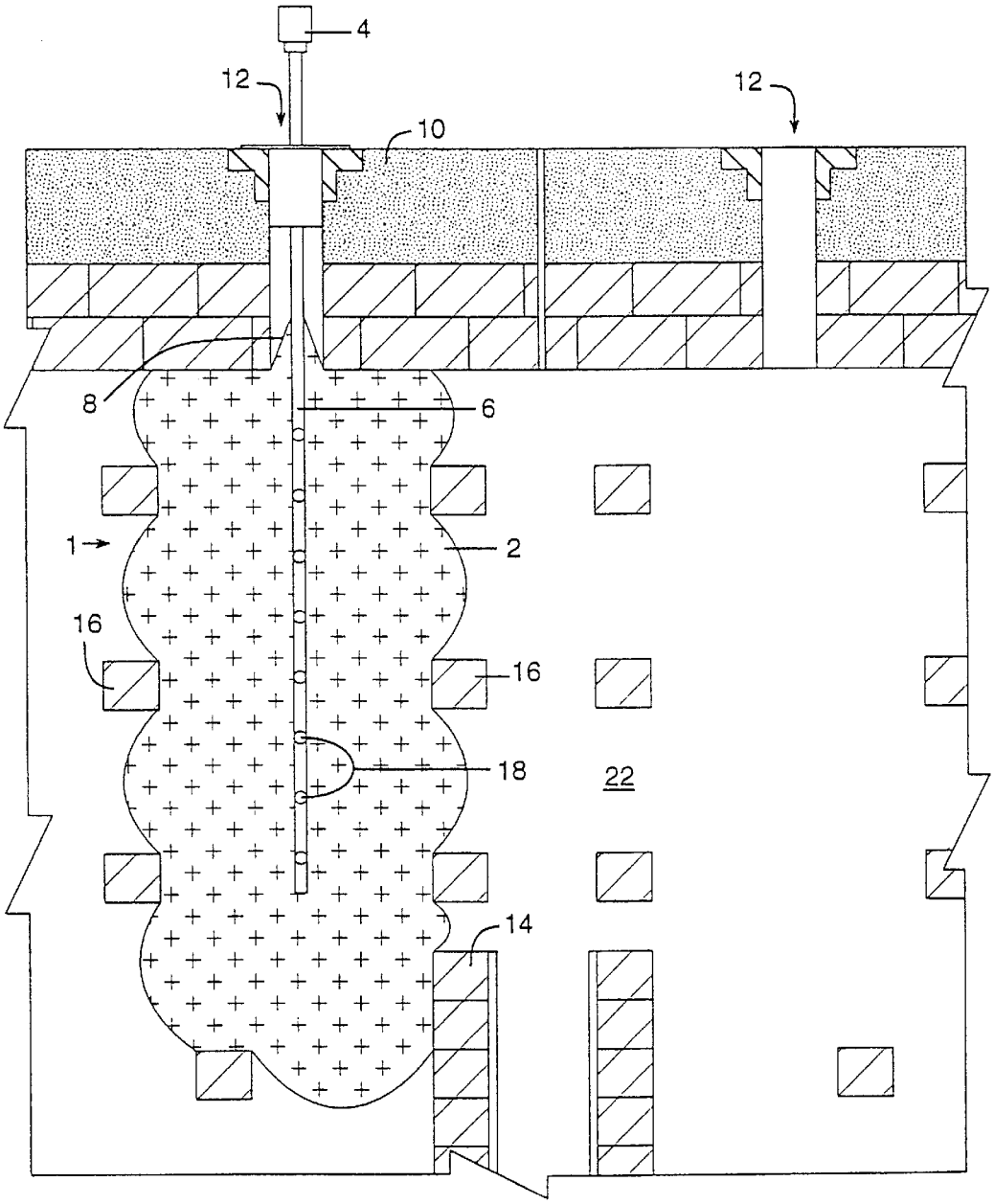
FIG. 1 is a crossectional view of a flue with the seal of the present invention.

Ring furnaces for baking carbon anode and cathode blocks used to produce aluminum are well known. (See U.S. Pat. No. 4,552,530 which is hereby incorporated by reference in its entirety). A ring furnace is constructed in a manner which enables sequential preheating, baking, and cooling molded carbon blocks held in chambers commonly called pits on a continuous basis. The progression of these sequential operations is enabled by the induced flow of flue gases, fuel, and combustion/cooling air in a closed rectangular loop or ring of furnace flues adjacent the pits; hence, the name ring furnace.

The flues are formed by long parallel rows of spaced apart refractory end-to-end fluewalls, with the row ends joined together by a common flue passage called a crossover. A typical ring furnace has from 12 to 24 parallel rows of flues, and two such crossovers. Half of the parallel flue rows reside in one side of a ring furnace and the other half reside in the other side of the furnace. Flue gas flow is in one direction through one side and in the opposite direction through the other side, the flow loop is closed by the common crossover flue at each end of the furnace.

The parallel rows of flues within each half furnace are spaced apart uniformly to form the sidewalls of open-top pits into which the carbon anode or cathode blocks are placed for baking. Pit width, depth and length are sized to efficiently accommodate the carbon blocks to be baked. Flue length and depth are conformed to pit length and depth. Pit and flue sizes typically are constant within a furnace, but differ from furnace to furnace. To form the end walls of individual pits and to interlock adjoining ends of fluewalls in each long row of flues, refractory headwalls are constructed laterally across each half furnace, at intervals determined by the desired pit length. In ring furnaces as built heretofore, the headwall width has typically been 18 inches between pits and 9 inches between the butting ends of flues where the fluewall ends fit into 4.5 inch deep vertical recesses (slots) on each side of the headwall. The lateral assembly of pits and fluewalls contained between successive headwalls in each half furnace is typically called a furnace section. Each section typically contains 5 to 11 pits and 6 to 12 flues. Each half furnace typically contains 16 to 48 sections (32 to 96 sections per furnace). The number of pits and flues per furnace section, and the number of sections per furnace, are a function of the output of baked blocks required from the furnace.

In operation of such a carbon baking furnace, sections of the furnace are at the same stage in the baking cycle at any given time. Sections are loaded and paced through the baking cycle in succession in a given direction, either clockwise or counterclockwise, around the furnace. At any given time, some sections of pits will be empty, some will be receiving their next loading of carbon blocks and packing coke, some will be heating, some soaking at final temperature, some cooling, some being unloaded, and some being repaired (reconditioned) prior to being reloaded for their next baking cycle. This operating cycle is imposed on each section of pits by a systematic repositioning of furnace firing equipment from section to section, at a specified frequency. The firing equipment consists of fabricated assemblies which rest on top of the furnace and typically are movable by overhead crane. The assemblies function to input fuel, input cooling and combustion air, exhaust spent flue gases, and control flue gas pressure and/or fluewall temperature. Each baking furnace typically has sufficient furnace sections for operation of multiple (usually 2 to 4) simultaneous baking cycles. Each baking cycle typically requires 16 to 26 tandem sections, the exact number being a function of the intended operating plan and expected pit productivity. Thus, a furnace for two simultaneous baking cycles, with 16 sections per cycle, would contain 32 furnace sections.

To complete each baking cycle, furnace refractories must be cycled through a wide temperature range. Fluewall temperature fluctuates from a low near room temperature to a high of 1250°–1350° C., and back to the low temperature. Headwalls are cycled through only a slightly lower temperature range. The temperature changes induce commensurate expansion-contraction reversals which cause movement, and shifting, in both the fluewalls and headwalls. Space for the expansion must be provided at the ends of each fluewall and at intervals within, or at the ends of, each headwall. The major headwall expansion is lateral (at 90°) to the direction of major fluewall expansion. In the past, this relative movement, and other factors such as in-service shrinkage within the refractories, results with time in an ever-increasing looseness of fit of fluewall to headwall at each pit corner. Yet this fit, between each pit face of a fluewall and the adjacent side face of the headwall recess, must be kept "coke-tight" to prevent leakage of packing coke from the pits to the recess then into the flues. The coke is in loose powder form and is placed around and on top of the carbon blocks in each pit to prevent carbon oxidation (air-burning) and conduct heat to and from the blocks. Loss of coke into the flues can restrict the flue passage and reduce combustion efficiency within the flues and heat transfer between flues and pits. Entrained in flue gases, coke dust may create a fire hazard in the exhaust system and/or an emissions problem. Within the flues, it can burn out of control, causing localized overheating which distorts the fluewalls. Flues may also become bowed due to loss of expansion space in headwall recesses if the recesses are filled with coke.

Each pit in a ring furnace is defined by a headwall on each end and a flue along each side. Pits vary in size depending upon the size and number of anodes to be fitted therein for baking. Carbon powder (coke) is packed into the spaces between adjacent anodes and between pit sidewalls and adjacent anodes.

The above components of a ring furnace are made from refractory bricks or specially formed shapes. The types and shapes of refractory may vary depending upon the application and anticipated maximum temperature to which the brick or shape may be exposed. The headwall is made up of refractory brick and is continuous across the entire length of a section of the furnace except for expansion joints. A typical headwall is 18 inches thick between pits with 4-½ inch opposing recesses at points of intersection with the flues which reduces the thickness of the headwall within the recesses to 9 inches. Expansion joints at or near flue centerlines are typically ⅛ inch and filled with a combustible fiberboard which burns out leaving a space for headwall expansion. The headwall is the full height of the pit.

Each flue is comprised of two spaced apart fluewalls made with refractory brick. Each flue in a section terminates within a headwall recess and a gap between the flue end and headwall within the recess is provided to accommodate expansion and contraction of the flue from temperature cycling. The lateral fit of each flue in the recess must be snug to prevent coke leakage into the recess.

The flue also contains baffles to direct the hot gases to the entire interior surface of the flue. It is important that there are baffles to direct the air flow, otherwise the hot gas would travel across the top of the flue and create a temperature gradient from top to bottom. It is important to direct the hot gas to the entire interior surface of the flue because a constant temperature should be achieved throughout the flue and ultimately the pit. The gases heat the flue which in turn radiates heat into the pit. A non-uniform distribution of heat would compromise the process and quality controls in anode baking. Various baffle arrangements are illustrated in U.S. Pat. No. 4,040,778 which is hereby incorporated by reference in its entirety. FIG. 1 shows a preferred arrangement of three baffles.

In addition to baffles, the interior of the flue contains spacers to keep the flue walls properly supported from the inside. Pressure is placed on the flue walls and additional support is required to resist this pressure to collapse inward.

The spacers are single bricks which span the flue width and are anchored in each wall.

As mentioned above, gas is circulated through the flues in a specific plan to heat the pits. Air is introduced through the exhaust ports and peepholes, is carried through the flue and mixed with hotter air and fuel, heated and carried out through the exhaust ports where it is scrubbed. The fuel is typically natural gas, but can be other hydrocarbons. Typically, fuel is introduced through the peepholes where it is spontaneously combusted in the flue. At that location, the internal temperature of the flue is well above the combustion temperature of the fuel so no starter flame is required.

The flue ends allow continuous passage of gases through a line of flues. In addition, an exhaust port is provided for exhausting flue gases. An exhaust port block covers the port at the top of the flue. A central opening through the block accommodates an inlet to a manifold for exhausting spent gases, or is opened to permit entry of air for cooling and combustion. The central opening is plugged to cap the port when such port is not being used as an exhaust or input point. Access through the central opening is also required for insertion of a flue end seal to stop the flow of gases at selected points during operation of the furnace.

The current methods of sealing flues use a flat heat resistant cloth over a masonite board to seal the approximate 9 in.×42 in. headwall port opening to prevent the exhaust manifold from drawing excess air from the flues beyond the fire train. The operator installs this seal on his hands and knees while balanced on an 18 in. wall over a deep pit. Depending on the age and condition of the furnace, this type of seal is often difficult to install and may not seal effectively. The presently preferred inflatable seal system uses a low pressure air fan and a combination of flexible and rigid tubing to inflate a flexible bladder. The seal is lightweight and can be installed by an operator without bending down. It provides a more effective seal for the often irregularly-shaped port openings, which saves horsepower in the baghouse draft requirements. A better seal will also minimize excursions in the firing and exhaust manifold operations. The ergonomics of this operation will be improved by eliminating bending and kneeling to install and remove the seal, and by eliminating the need to remove and install the 35 pound iron headwall cap one time per cycle. It is intended to place this seal closer to the exhaust manifold, which should significantly improve backdraft elimination.

The presently preferred inflatable seal 1 is shown in FIG. 1. It comprises an inflatable bladder 2 made of a semi permeable, heat resistant material; a means to deliver air under pressure, such as an air fan or low power/pressure air source 4, a shaft 6; the inflatable bladder is long enough to extend from the flue top 10, through a peephole 12 to a headwall 14 and seal off the communication between flues at the headwall port 22 when inflated. The bladder 2 is pressed against spacers 16, the flue walls, and the headwall 14.

The bladder 2 for the presently preferred inflatable seal 1 can be made from permeable or impermeable membranes, materials or fabrics. Preferably, the bladder 2 is semi-permeable to allow for easy deflation. If the material is permeable or semi permeable, then the bladder 2 must be kept inflated by some means. For example, the air fan or low power/pressure air source 4 can inflate the bladder 2 and can maintain pressure within the bladder 2. Obviously, the amount of air charging the bladder 2 is a function of the permeability of the material. The preferred material is heat resistant, although the seal 1 is placed upstream of the more intensely heated portions of the flue. "Heat resistant" is defined to mean that the fabric is capable of withstanding heat at 250° F. continuously without degradation. Preferably, the material can withstand temperatures of 450° F. continuously without degradation. Examples, of preferred materials include fabrics such as nylon, Dacron or Nomex and others that are used for the bags used in constructing hot air balloons. Additionally, a coating such as urethane, silicon, or Teflon can be applied. The preferred coating is designed to be heat resistant and to be low in permeability. Preferably, the coating is urethane and it is applied at a rate of ½ to 1 ounce per square yard. More preferably, it is applied at a rate of approximately ¾ ounce per square yard. The amount of material needed to make a preferred seal is approximately a few square yards. Preferably, the material is urethane coated nylon, having a rating of 200 to 400 denier. A particularly preferred bladder is constructed from two pieces of material. A bottom piece is fashioned from a heavier cloth than the sides and top for increased wear resistantance. Preferably, the cloth is a 400 denier nylon pack cloth with a ¾ ounce per square yard urethane coating. Preferably, it has a warp and fill rating of 60/50. The side and top piece is preferably constructed of a 200 denier nylon cloth with a ¾ ounce per square yard urethane coating. Preferably, it has a warp and fill rating of 60/50. The cloth has a zepel finish, with medium firm pliability. The cloth is an oxford weave.

The bladder 2 can be inflated with a low power/pressure air source or an air fan 4. A low power fan that typically operates on a home vacuum is acceptable for a semi-permeable bladder. Preferably, the bladder 2 is fully inflated throughout the operation of baking process. It is inflated at the start of the cycle and deflated at the end of the cycle, but, put back in to operation soon thereafter as the pits are rotated. As mentioned above, it may be necessary to maintain air pressure within the bladder 2 using the air fan or low power/pressure air source 4 depending on the permeability of the bladder 2. Preferably, the air source 4 is capable of reverse flow to enable easy deflation of the seal 1.

Preferably, the bladder 2 is fixed to a shaft 6 to provide some support and to deliver the air. In the preferred embodiment, the shaft 6 extends throughout most of the length of the seal 1 and is used to push the uninflated seal 1 into the peephole 12 or exhaust flue from the inside of the bladder 2. It should be understood that a shaft 6 is not absolutely necessary for the preferred seal 1 to function. A shaft 6 can be made from many types of materials. A metal shaft is preferred. Air vents 18 can be placed along the length of the shaft.

The preferred bladder 2 is relatively long and narrow. It should be large enough to seal the headwall port 22 between flues so that gaseous communication is interrupted. Typically, the flues are relatively narrow and the distance between the top of the flue and a headwall 14 like barrier is relatively long. Widths of between 16 and 21 inches are typical and the size of the headwall port is typically between 3 and 5 feet deep. However, it must be appreciated that these dimensions are highly variable and depend on the actual dimensions of the particular flue being used.

The presently preferred seal 1 is designed to fit within a peephole 12 or an exhaust port. Preferably, the seal 1 is itself sealed within either of these holes so that the bladder 2 will fit appropriately. It should be understood that an absolute seal is not necessary as the bladder 2 is preferably sealed against the shaft 6 to prevent pressure loss. Preferably, the seal 1 itself is used to close off the area at the opening to the outside, such as the top of the peephole 12, for-example. Preferably, the bladder 2 is gathered using elastic material at the top of the bladder 8. This excess material allows the top of the bladder 8 to inflate and seal off all the space in the peephole 12 and insure that air does not travel between the flue and the outside. The elastic material that is used to create the gathers is preferably heat resistant. Preferably, the gathers extend down to approximately 1 foot into the flue and beyond the lower part of the flue top.

The present invention has been described with referenced to specific embodiments. However, the application is intended to cover those changes and substitutions which may be made by those skilled in the art without departing from the spirit and scope of the appended claims.

What is claimed is:

1. A method for sealing a fluid passageway between adjacent flues in a carbon anode baking furnace, comprising:

inserting a heat resistant, inflatable bladder in a flue that is to be sealed;

inflating the bladder to close the passage of air between flues; and maintaining the barrier.

2. A method for baking carbon anodes, comprising;

connecting firing equipment to at least one section of a carbon anode baking furnace;

inserting an inflatable seal in accordance with claim 1;

operating the firing equipment throughout a baking cycle;

deflating and removing the inflatable seal from the flue after the baking cycle is complete; and repositioning the firing equipment.

3. A method for sealing a fluid passageway between adjacent flues in a carbon anode baking furnace, a flue being generally rectangular in shape and comprising a flue top and bottom, a headwall on either end of the flue, two walls, an opening in the flue top, at least one baffle, and a plurality of spacers which are connected to both walls of the flue, the headwall, the two walls and the flue top define a headwall port which permits fluid passage between adjoining flues; the process comprising:

inserting a sealing device into a flue, the sealing device comprises; an inflatable bladder made of a semi permeable, heat resistant material; a means to deliver air under pressure connected to the inflatable bladder by a seal to prevent air leakage between the means to deliver air under pressure and the inflatable bladder; a shaft between the means to deliver air under pressure and the inflatable bladder, the shaft having vents along its length; the inflatable bladder is long enough to extend from the flue top to a headwall and seal off the communication between flues at the headwall port when inflated;

operably connecting an air pressure means to the sealing device;

inflating the sealing device with the air pressure means to seal the flue from fluid communication with adjacent flues; and maintaining the fluid pressure within the sealing device.

4. A method for baking carbon anodes, comprising;

connecting firing equipment to at least one section of a carbon anode baking furnace;

inserting an inflatable seal in accordance with claim 3;

operating the firing equipment throughout a baking cycle;

deflating and removing the inflatable seal from the flue after the baking cycle is complete; and repositioning the firing equipment.

5. A method for manufacturing a sealing device for sealing a fluid passageway between adjacent flues in a carbon anode baking furnace, the method comprises;

fashioning a semi permeable, heat resistant material into an inflatable bladder having an opening;

fixing and sealing the opening of the inflatable bladder to a hollow shaft, and once connected to the inflatable bladder, the shaft has an opening that communicates with the interior of the inflatable bladder and one end that communicates with the exterior of the bladder;

connecting an air pressure means to the shaft opening that is in communication with the exterior of the inflatable bladder; and sealing the connection between the air pressure means and the interior of the bladder.

6. A method in accordance with claim 5 further comprising coating the semi permeable, heat resistant material.

* * * * *